US006930873B2

(12) United States Patent
Hallbjörner et al.

(10) Patent No.: US 6,930,873 B2
(45) Date of Patent: Aug. 16, 2005

(54) MICRO ELECTROMECHANICAL SWITCHES

(75) Inventors: Paul Hallbjörner, Göteborg (SE); Erik Carlsson, Mölnlycke (SE)

(73) Assignee: Telefonaktiebolaget L M Erisson (publ), Stockholm (SE)

( * ) Notice: Subject to any disclaimer, the term of this patent is extended or adjusted under 35 U.S.C. 154(b) by 0 days.

(21) Appl. No.: 10/750,900

(22) Filed: Jan. 5, 2004

(65) Prior Publication Data

US 2004/0136138 A1 Jul. 15, 2004

Related U.S. Application Data

(62) Division of application No. 10/112,046, filed on Apr. 1, 2002, now Pat. No. 6,720,851.

(30) Foreign Application Priority Data

Apr. 2, 2001 (SE) ..... 0101182

(51) Int. Cl.[7] ..... H01H 47/00
(52) U.S. Cl. ..... 361/139; 361/154; 361/160
(58) Field of Search ..... 361/139, 233, 361/150, 152, 154, 115, 58, 220, 225

(56) References Cited

U.S. PATENT DOCUMENTS 5,621,157 A 4/1997 Zhao et al. ..... 73/1.38
5,717,631 A 2/1998 Carley et al. ..... 365/174
5,848,206 A 12/1998 Labeye et al. ..... 600/534
6,452,124 B1 9/2002 York et al. ..... 361/233

FOREIGN PATENT DOCUMENTS

CN 1258851 7/2000 ..... G02B/6/35

OTHER PUBLICATIONS

Chinese Office Action for Chinese Application No. 02807861.6; Date of Issue: Oct. 15, 2004.

IEEE *Journal of Microelectromechanical Systems*, Jun. 1999, vol. 8, No. 2, pp. 129–134, ISSN 1057–7157 , Z. Jamie Yao et al., "Micromachined Low–Loss Microwave Switches".

IEEE *Transactions on Microwave Theory and Techniques*, Nov. 1998, vol. 46, No. 11, pp. 1868–1880, ISSN 0018–9480, Elliott R. Brown, "RF–MEMS Switches for Reconfigurable Integrated Circuits".

*Primary Examiner*—Stephen W. Jackson
(74) *Attorney, Agent, or Firm*—Nixon & Vanderhye P.C.

(57) ABSTRACT

Characteristics of micro electromechanical switches can be changed by applying a control signal which either changes one or more parameters of the micro electromechanical switches or which controls beam movement by feedback signals. It is thereby possible to change switching transient time, maximum switching frequency, power tolerance, and/or sensitivity (actuation voltage) of a micro electromechanical switch.

4 Claims, 5 Drawing Sheets

MICRO ELECTROMECHANICAL SWITCHES

This application is a divisional of application Ser. No. 10/112,046, filed Apr. 1, 2002, now U.S. Pat. No. 6,720,851 the entire content of which is incorporated herein by reference.

TECHNICAL FIELD

The invention concerns micro electromechanical switches and more particularly micro electromechanical switch circuits.

BACKGROUND

Micro electromechanical switches are used in a variety of applications up to the microwave frequency range. A micro electromechanical switch is usually a beam with support at one or both ends. The support will normally either extend above a substrate surface or be level with the substrate surface, i.e. a micro electromechanical switch is normally built on top of the substrate surface or into the substrate. The beam acts as one plate of a parallel-plate capacitor. A voltage, known as an actuation voltage, is applied between the beam and an actuation electrode, the other plate, on the switch base. In the switch-closing phase, or ON-state, for a normally open switch, the actuation voltage exerts an electrostatic force of attraction on the beam large enough to overcome the stiffness of the beam. As a result of the electrostatic force of attraction, the beam deflects and makes a connection with a contact electrode on the switch base, closing the switch. When the actuation voltage is removed, the beam will return to its natural state, breaking its connection with the contact electrode and opening the switch. Important parameters of micro electromechanical switches are their sensitivity to an actuation voltage and their transient time. A short transient time (high switching frequency) will result in a very high actuation voltage and vice versa since they, at least in part, depend on the same physical properties of the switch. There is room for improvement in the control of micro electromechanical switches.

SUMMARY

An object of the invention is to define a manner to control the transient time of micro electromechanical switches.

Another object of the invention is to define a manner to control the sensitivity of micro electromechanical switches.

A further object of the invention is to define a manner of controlling at least one physical characteristic of micro electromechanical switches on which at least one of either a sensitivity or a transient time of micro electromechanical switches depend.

A still further object of the invention is to define a micro electromechanical switch which is resilient to externally induced mechanical influences.

The aforementioned objects are achieved according to the invention by changing the characteristics of micro electromechanical switches by applying a control signal which either changes one or more parameters of the micro electromechanical switches or which controls beam movement by feedback signals. It is thereby possible to change switching transient time, maximum switching frequency, power tolerance, and/or sensitivity (actuation voltage) of a micro electromechanical switch.

The aforementioned objects are also achieved according to the invention by a micro electromechanical switching structure. The structure comprises a switching element which in turn comprises a first switching support, a switching actuator control electrode, and a switching beam having a first end and a second end, the first end of the switching beam being supported by the first switching support. According to the invention the micro electromechanical switching structure further comprises a first reconfiguration support, a first reconfiguration beam and a first reconfiguration actuator control electrode. The first reconfiguration support is spaced apart from the first switching support. The first reconfiguration beam comprises a first end and a second end. The first end of the first reconfiguration beam is supported by the first reconfiguration support and the second end of the first reconfiguration beam is supported by the first switching support. The first reconfiguration actuator control electrode is arranged between the first reconfiguration support and the first switching support. Further according to the invention the first switching support is ductile, suitably horizontally ductile, to thereby enable transfer to the switching beam of tension variations of the first reconfiguration beam caused by actuation of the first reconfiguration beam by means of the first reconfiguration actuator control electrode, which actuation thereby changes characteristics of the switching element.

Preferably the first reconfiguration support is an anchor, i.e a rigid support being more or less uninfluenced by created tensions. In some applications the switching element further comprises a second switching support, the second end of the switching beam is then supported by the second switching support. Suitably the second switching support is also of an anchor type. Also in some applications the micro electromechanical switching structure further comprises a second reconfiguration support, a second reconfiguration beam and a second reconfiguration actuator control electrode. The second reconfiguration support is spaced apart from the second switching support. The second reconfiguration beam comprises a first end and a second end. The first end of the second reconfiguration beam is supported by the second reconfiguration support and the second end of the first reconfiguration beam is supported by the second switching support. The second reconfiguration actuator control electrode is arranged between the second reconfiguration support and the second switching support. The second switching support is also ductile, suitably horizontally ductile, to thereby enable transfer of tension variations of the second reconfiguration beam caused by actuation of the second reconfiguration beam by means of the second reconfiguration actuator control electrode, to the switching beam. The second reconfiguration support can be an anchor.

The aforementioned objects are also achieved according to the invention by a micro electromechanical switching arrangement comprising a switching element. The switching element comprises a first support, an actuator control electrode, and a switching beam having a first end and a second end. The first end of the switching beam is supported by the first support. According to the invention the micro electromechanical switching. arrangement further comprises a switching beam position measurement device and an actuator control signal unit. The switching beam position measurement device generates a beam position signal related to a position of the switching beam in relation to a position of the actuator control electrode. The actuator control signal unit generates an actuator control signal in dependence on the beam position signal and a desired switching beam position signal, the actuator control signal being coupled to the actuator control electrode. In some applications the switching element further comprises a second support, the second end of the switching beam is then supported by the second support. Preferably the switching beam position measurement device utilizes capacitive measurement methods for generating the beam position signal. Suitably the switching beam position measurement device comprises a variable capacitance element and a Wheatstone bridge in which the variable capacitive device is one element.

By providing a micro electromechanical switching circuit according to the invention a plurality of advantages over prior art micro electromechanical switching circuit are obtained. Primary purposes of the invention are to make flexible micro electromechanical switches with variable/changeable characteristics. This will enable higher production yields, the switches can be trimmed after production to desired specifications, and/or the switches can be used in a broader variety of applications with either different requirements on the specifications and/or requirements of changeable specifications/characteristics. MEMS switches according to the invention are also more resilient to external mechanical influences, such as vibrations etc., i.e. a knock on the MEMS switch will not cause the beam of the switch to vibrate uncontrollably, but instead any such external mechanical disturbances will be dampened either by the beam gap control loop or by the tightening of the switch beam by the reconfiguration elements.

Other advantages of this invention will become apparent from the detailed description.

BRIEF DESCRIPTION OF THE DRAWINGS

The invention will now be described in more detail for explanatory, and in no sense limiting, purposes, with reference to the following figures, in which.

DETAILED DESCRIPTION

In order to clarify the method and device according to the invention, some examples of its use will now be described in connection with FIGS. 1 to 8.

Figure 1:
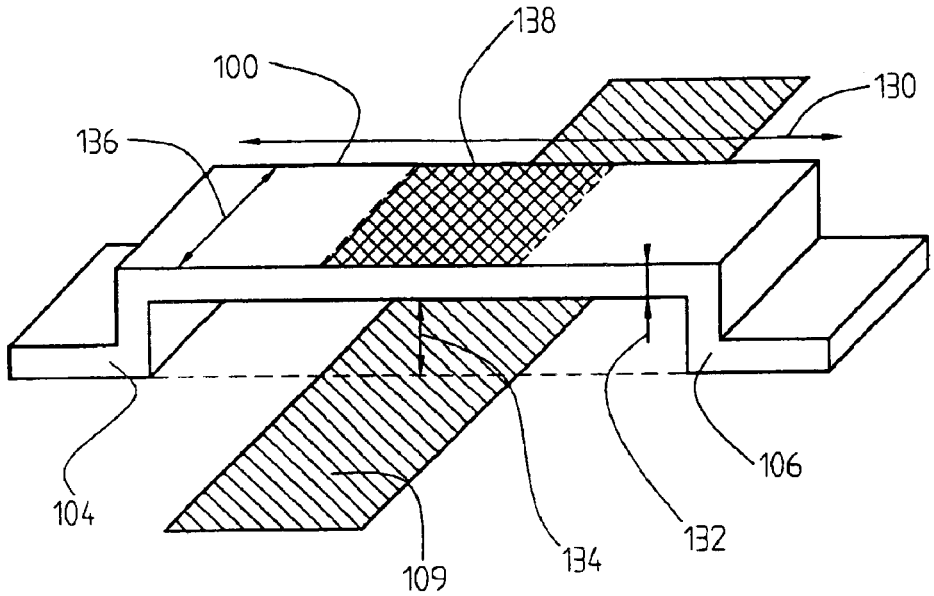
FIG. 1 shows a micro electromechanical switch.

As is shown in FIG. 1, a micro electromechanical system (MEMS) switch comprises a beam 100 supported by two supports 104, 106. Some MEMS switches only have one support supporting a beam, these are called cantilever type MEMS switches. A MEMS switch can be manufactured to either look somewhat as illustrated in FIG. 1, with the supports 104, 106 being on top of a substrate, i.e. protruding from the substrate, in which case the substrate coincides with a base of the switch. Or a MEMS switch can be manufactured by creating a depression in the substrate under the beam, which is then supported at one or both ends by the surrounding substrate. The base of the switch will in these MEMS switches not coincide with the substrate, but be located at the bottom of the depression under the beam. There exists other MEMS types, but these will not be mentioned explicitly.

An actuation electrode 109, possibly combined with a signal electrode, is placed underneath the beam 100 on the switch base, which in this type coincides with the substrate. The actuation electrode 109 in MEMS switches are sometimes combined with the signal electrode, especially in these types and when utilized with high frequencies, the commonly used DC voltage as actuation voltage is then easily separated from the signal. When an actuation voltage is applied between the actuation electrode 109 and the beam 100, a force on the beam 100 is created and will cause the beam 100 to be attracted to the actuation electrode 109, and the switch is in an active state. A MEMS switch is a single pole single throw switch and can either be of a normally open type or of a normally closed type. A normally open MEMS switch can be accomplished by dividing a signal electrode directly underneath a beam, i.e. creating a gap in the signal electrode, such that a conductive surface underneath the beam is able to overbridge the gap when the MEMS switch is active. When the MEMS switch is inactive the signal path is broken and when the MEMS switch is active the signal path is complete. A normally closed MEMS switch can be accomplished by having at least a part of the beam that comes into contact with a signal electrode, being conductive to ground. When the MEMS switch is inactive, the signal path is complete and will thus transmit any desired signals. When the MEMS switch is active, the signal electrode will be grounded, thus breaking the signal path.

Different characteristics, such as transient time and a necessary actuation voltage, of a MEMS switch will to a large extent be dependent on the beam's spring constant, i.e. its susceptibility to deflect, which in turn is dependent on its bending resistance, flexibility, and in the case of a beam 100 with two supports also the built in tension. The spring constant $k_s$ can be given by: $k_s=4WH((EH^2/L^2)+\sigma)/L$ , where L is the beam length 130, H is the beam thickness 132, W is the beam width 136, $\sigma$ is the tension of the beam in the longitudinal direction, and E is the modulus of elasticity for the beam material. The spring constant is of central importance as it influences several of the most important parameters of a MEMS switch, such as switching voltage value, transient time (maximum switching frequency), and its power tolerance. The switching voltage value, actuation voltage, is the control voltage necessary for the beam to go down to its bottom position. The actuation voltage is given by: $V_c=((8\ k_s g_o^3)/(27\epsilon A))^{1/2}$ where $g_o$ is the maximum gap 134 between beam and actuation electrode (zero actuation voltage), $\epsilon$ is the dielectric constant in the gap, and A is the overlapping area 138 on the beam and the actuation electrode. The maximum switching frequency is approximately equal the mechanical resonance frequency of the beam. This is given by: $f_m=(k_s/m)^{/1/2}/(2\pi)$ where m is the mass of the beam. The transient time is the inverse of $f_m$. The power tolerance limits of a MEMS switch comes from the influence the signal has on the beam. If the effective value of the signal voltage exceeds the actuation voltage Vc, then the MEMS switch closes (or is prevented from opening) by the signal itself. Since the power is proportional to the voltage squared then the maximum power is proportional to the spring constant.

Traditionally these different parameters are changed/decided upon during manufacture of a MEMS to thus attain a MEMS switch with a desired set of characteristics. There are certain disadvantages with this method, in that the manufacturing process might not be accurate enough to actually produce a MEMS switch with the desired characteristics. Further it might be desirable to actually change the characteristics of a MEMS switch during its normal use. Perhaps most importantly there is no way to change the characteristics of a MEMS switch after manufacture, making it difficult to produce generalized MEMS switches which can then be either dynamically or statically adapted to possess desired characteristics. According to the invention one or more characteristics of a MEMS switch can be changed/adjusted after manufacturing of the switch, either dynamically during use or statically as a setting.

Figure 2A:
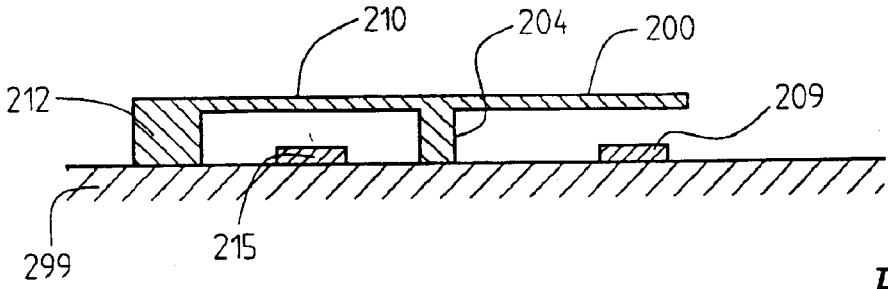
FIG. 2A–2B shows two different states of a first embodiment according to a first aspect of the invention.

In a first embodiment of the invention according to a first aspect, the distance $g_o$ 134 is adjustable. The first embodiment is a basic cantilever type MEMS switch as is shown in FIG. 2A with a switch beam 200 held in place by a single switch beam support 204 on a substrate/switch base 299. A switch actuation and possibly also signal electrode 209 is placed underneath the switch beam 200. According to the invention the MEMS switch further comprises a reconfiguration part/element which comprises a reconfiguration beam 210, a reconfiguration beam support 212, and a reconfiguration actuation electrode 215. The reconfiguration beam 210 is further supported by the switch beam support 204, i.e. the switch beam support 204 is located in between the reconfiguration beam 210 and the switch beam 200. The reconfiguration element is shown in its inactive state in FIG. 2A, i.e. there is no actuation voltage between the reconfiguration actuation electrode 215 and the reconfiguration beam 210. The MEMS switch 200, 204, 209, will then display a first type of behaviour based on the given parameters according to the discussion around FIG. 1.

Figure 2B:
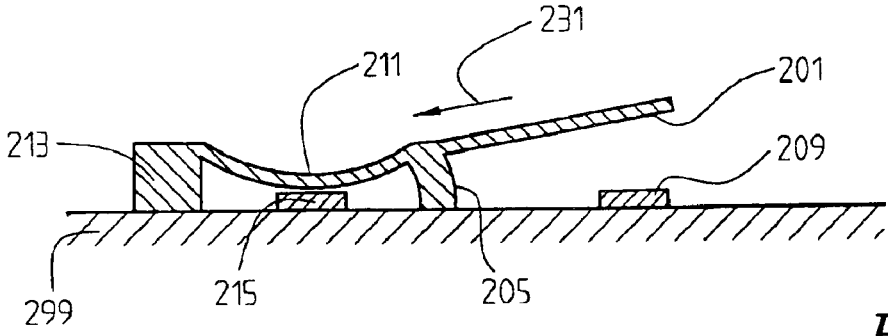

By putting the reconfiguration element in an active state, shown in FIG. 2B, the MEMS switch will display a second type of behaviour based on the changed parameter(s). The reconfiguration beam 211 will bend towards the reconfiguration actuation electrode 215. By bending, the reconfiguration beam 211 will exert a force 231 on the switch beam support 205, bending the switch beam support 205, thus lifting the switching beam 201 further away from the actuation/signal electrode 209, i.e. go increases. The switch beam support 205 has to at least be so ductile that the force 231 will influence the switch beam support 205 and transfer this influence to the switching beam 201. The reconfiguration beam support 213 is preferably of an anchor type, i.e. rigid enough to not be influenced to a noticeable extent. If the reconfiguration beam support 213 is of an anchor type, then most of the force generated by the bending of the reconfiguration beam 211 will influence the switch beam support 205. If the reconfiguration beam support 212, 213 is not of an anchor type, then the force 231 will be smaller, which could be desirable is some embodiments.

By providing a reconfiguration element according to the invention, and having a ductile switch beam support 204, 205 on a cantilever MEMS switch, it is possible to control go in at least two different steps. If it is possible to bend the reconfiguration beam 210, 211 continuously, then a continuous change of go is attained. A change of go will mainly change the required actuation voltage of the MEMS switch, i.e. according to this embodiment of the invention it is possible to control, dynamically or in a static manner, the required actuation voltage to activate the MEMS switch. This will enable a higher yield of MEMS circuits, since even circuits which do not fall within the required specification from the start can be trimmed by reconfiguration elements. The same MEMS switch can be used in different applications requiring different characteristics/specifications. A transceiver can use the same MEMS switches for both reception and transmission. During reception the reconfiguration element is inactive since there is not much power flowing through a signal electrode of the MEMS switch, and during transmission the reconfiguration element becomes active to allow the MEMS switch to handle more power without becoming unintentionally activated.

Figure 3A:
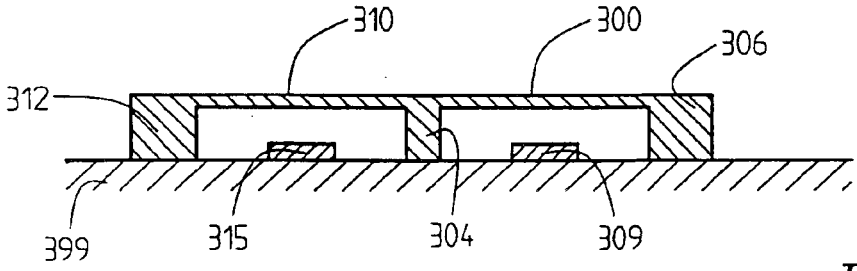
FIG. 3A–3B shows two different states of a second embodiment according to a first aspect of the invention.
Figure 3B:
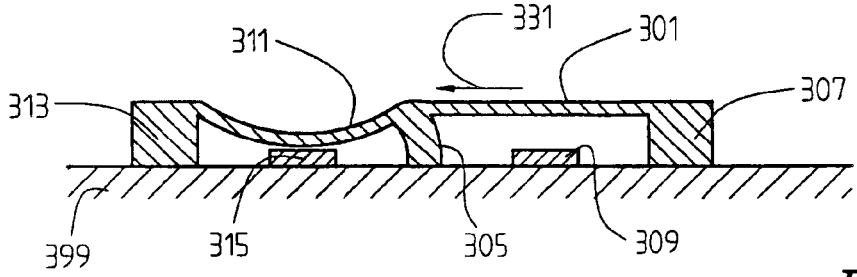

FIGS. 3A, 3B show two different states of a second embodiment of the invention according to a first aspect. The second embodiment involves a basic bridge type MEMS switch on a substrate 399 with a switch beam 300, 301 being supported by two switch beam supports 304, 305, 306, 307 one at each end of the beam 300, 301. The basic functioning is otherwise the same as that of the basic cantilever type. A reconfiguration element comprising a reconfiguration beam 310, 311, a reconfiguration beam support 312, 313, and a reconfiguration actuation electrode 315 is connected to the MEMS switch by means of the reconfiguration beam 310, 311 being supported at one end by a first switch beam support 304, 305. In contrast to the first embodiment, when the reconfiguration element is activated, then the resulting force 331 does not primarily influence $g_o$, but the tension of the switch beam 301, i.e. $\sigma$, the tension of the beam in the longitudinal direction. $\sigma$ influences the spring constant $k_s$, this results in that the actuation voltage $V_c$ and the maximum switching frequency $f_m$. As in the first embodiment, the first switch beam support 304, 305 should be ductile enough to transfer a tension 311 created by the bent reconfiguration beam 311. The reconfiguration beam support 313 and the second switch beam support 307, can in some embodiments suitably be of an anchor type.

FIG. 4 shows three different states of a third embodiment of the invention according to a first aspect. The MEMS switch comprises, as in the previous embodiment, a switch beam 400, 401, 402, a first switch beam support 404, 405, a second switch beam support 406, 407, 408, and a switch actuation/signal electrode. The third embodiment also comprises a first reconfiguration element which comprises a first reconfiguration beam 410, 411, a first reconfiguration support 412, 413, and a first reconfiguration actuation electrode 415. The third embodiment further comprises a second reconfiguration element, which comprises a second reconfiguration beam 420, 421, a second reconfiguration beam support 422, 423, and a second reconfiguration actuation electrode 425. The first reconfiguration beam 410, 411 is supported by the first reconfiguration support 412, 413 on one side and by the first switch beam support 404, 405 at the other end. The second reconfiguration beam is supported by the second switch beam support 406, 407, 408 at one end and by the second reconfiguration support 422, 423 at the other end. The switch beam 400, 401, 402 is supported by the first switch beam support 404, 405 at one end and by the second switch beam support 406, 407, 408 at the other end.

Figure 4A:
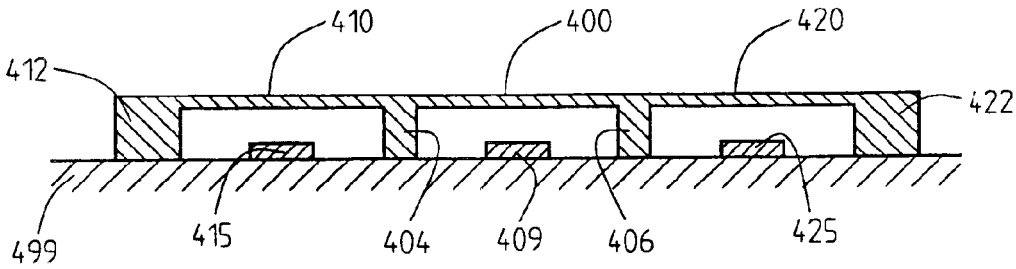
FIG. 4A–4C shows three different states of a third embodiment according to a first aspect of the invention.
Figure 4B:
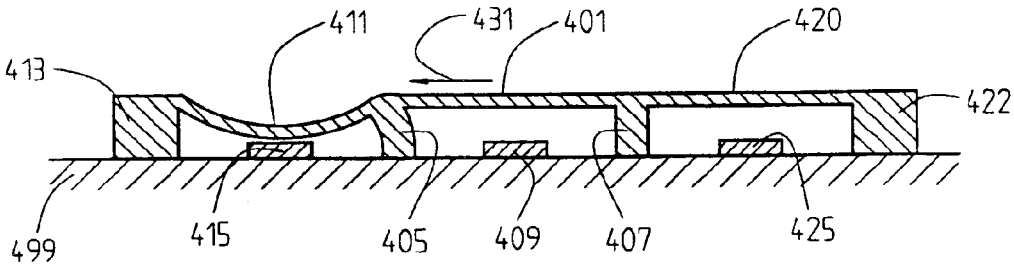
Figure 4C:
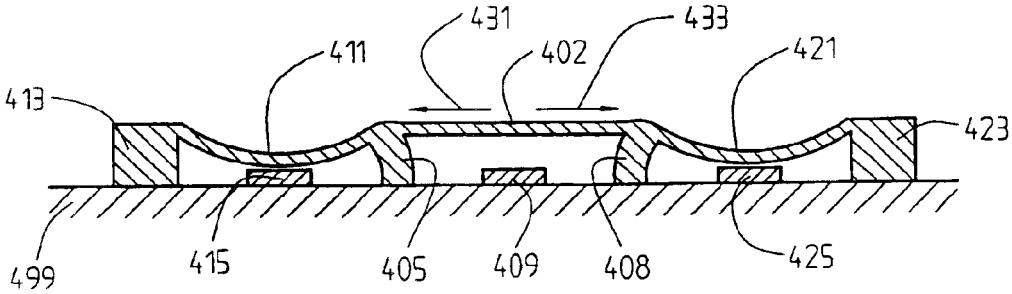

This third embodiment of the invention according to a first aspect enables an even further control of a MEMS switch by the use of two reconfiguration elements, one on each side of the switch. By only actuating the first reconfiguration element, as is shown in FIG. 4B, one force 431 is adding tension to the switch beam 401. By also actuating the second reconfiguration element, as is shown in FIG. 4C, a second force 433 is also adding tension to the switch beam 402. Thus three basic states are achieved, a first state with only the built in tension of the switch beam 400, as shown in FIG. 4A, a second state with an additional tension by one reconfiguration beam by a first force 431, as is shown in FIG. 4B, and finally a third state with the additional tension by both reconfiguration beams by the two forces 431, 433, as is shown in FIG. 4C. If the reconfiguration elements can only achieve an active or non-active state then there are these three different tensions, on the other hand if one or both of the reconfiguration elements can be changed continuously, then a very large range of different tensions of the switch beam 400, 401, 402, can be attained. This will provide the possibility to change the spring constant $k_s$ and thus the switch parameters as discussed above.

In some applications it might not be enough to add one or two reconfiguration elements to properly attain desired characteristics from a MEMS switch. It is especially noted that there is an increasing desire to improve the maximum switch frequency, or perhaps more importantly reduce switching transit delays, i.e. reduce the switch speed and reduce any settling/transient time. The settling time can be reduced considerably by controlling the switch beam according to a second aspect of the invention. According to the invention a switch beam is measured as to its current position and this is compared with a desired position of the switch beam, the actuation electrode is controlled to minimize a compared difference.

Figure 5:
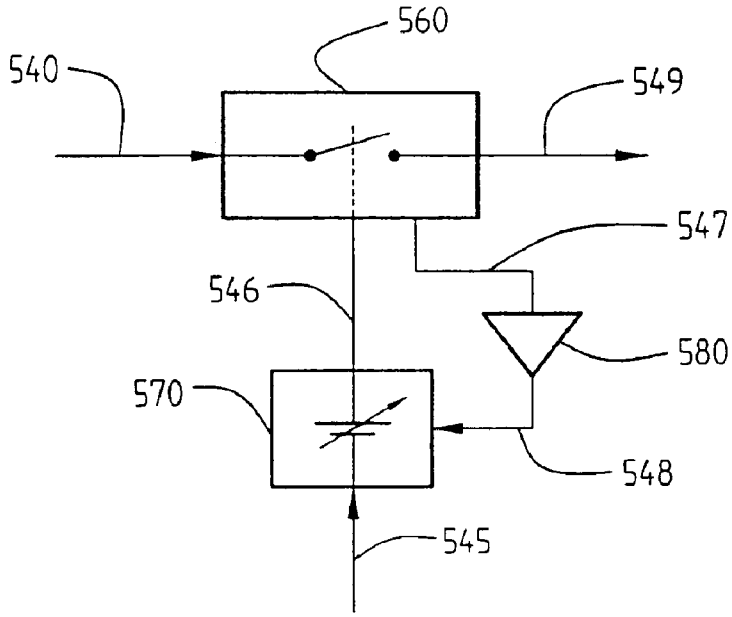
FIG. 5 shows a control loop according to a second aspect of the invention.

FIG. 5 shows a MEMS switch with a control loop according to a second aspect of the invention. The MEMS switch 560 comprises a signal entry 540, a signal exit 549, and an entry of a control signal 547 which is connected to an actuation electrode of the MEMS switch. Attached to the MEMS switch is a feedback unit 580, and a comparator/control signal source 570. The state of the MEMS switch 560 is controlled by a switch input control signal 545 which enters the comparator/control signal source 570 which will compare the value of the switch input control signal 545 with the state of the switch by means of a beam position feedback signal 548. If these signals 545, 548 differ in state, then the actuation signal 546 to the MEMS switch will change value to diminish the difference between the switch input control signal 545 and the beam position feedback signal 548. The change of value of the actuation signal 546 will influence a position of the beam 547 which is measured by the feedback unit 580 which in turn will change the beam position feedback signal accordingly. By this control loop the beam of the MEMS switch 560 is forced into a desired position as quickly as possible and reducing the transient time by dampening any oscillations of the beam. The control loop will also assure that any externally induced mechanical influences on the beam of the MEMS switch 560, will also be dampened. The beam gap/beam position is controlled by the control loop.

Figure 6:
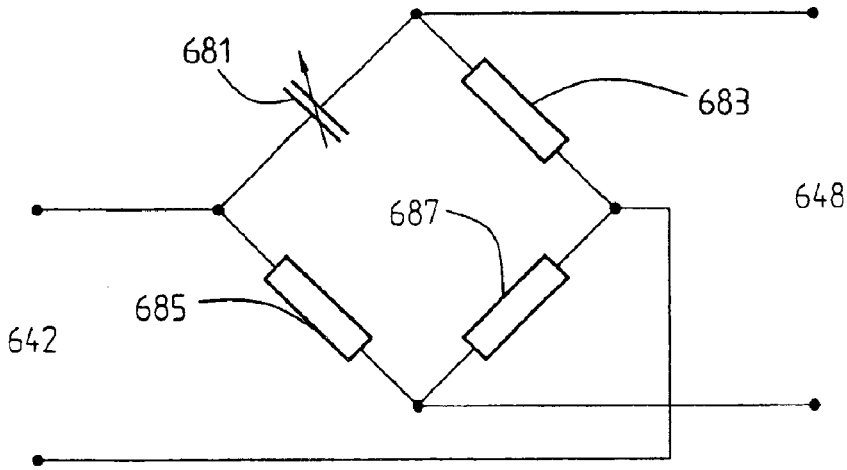
FIG. 6 shows an example of a feedback unit according to a second aspect of the invention.

FIG. 6 shows an example of a feedback unit, as that shown in FIG. 5, according to a second aspect of the invention. The feedback unit can suitably be built as a Wheatstone bridge, comprising a power feed 642 of the Wheatstone bridge, an exit 648 giving a beam positional value, a beam positional measurement element 681 and a further three bridge elements, a first bridge element 683, a second bridge element 685, and a third bridge element 687. The second bridge element 685 is suitably of a same type as the beam positional measurement element 681. The first bridge element 683 and the third bridge element 687 are preferably of the same kind and type. The positional measurement element 681 suitably comprises a first electrode plate on a beam whose position is to be measured, and a second electrode plate underneath the first plate on the beam thus creating a capacitor whose capacitance will vary with the position of the beam in question.

Figure 7:
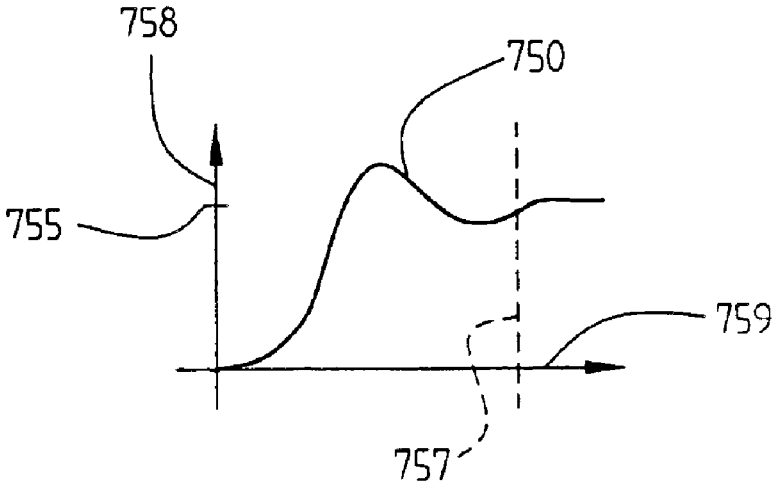
FIG. 7 shows a transition of a micro electromechanical switch from one state to another state in relation to time.

FIG. 7 shows a positional 758 transition 750 of a micro electromechanical switch beam from one state to another state in relation to time 759. There are several oscillations of the position 750 of the beam before it reaches a desired position 755. The settling/transient time 757 is first after the position 750 has settled at the desired place 755, which in this case, without a control loop according to the invention, is rather long.

Figure 8:
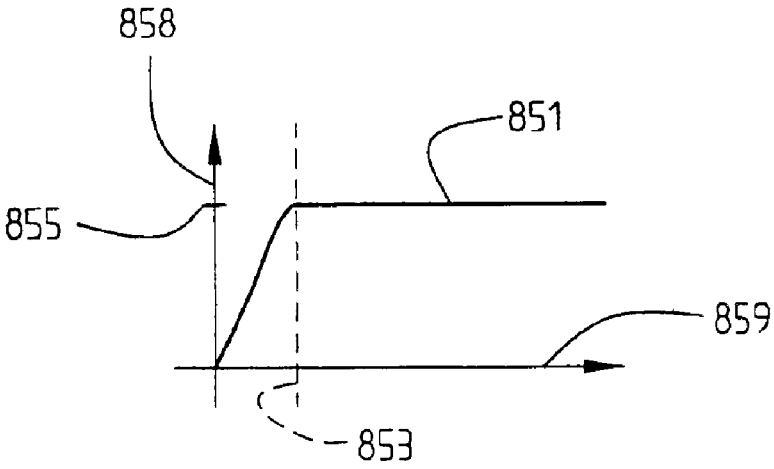
FIG. 8 shows a transition of a micro electromechanical switch comprising a control loop according to a second aspect of the invention.

FIG. 8 shows a positional 858 transition 851 in relation to time 859 of a MEMS switch beam of a MEMS switch comprising a control loop of the invention according to a second aspect of the invention. With control over the position of the beam, there are no oscillations, or only very small ones. The transient time 853 is thus very short, i.e. the time it takes the beam to settle at a desired position 855 is very small. The MEMS switch thus becomes fit for use much faster, which means that the range of applications for MEMS switches increases and/or the production yield of MEMS switches increases since a larger tolerance can be accepted since the MEMS switches can be corrected after production.

The basic principle of the invention is to be able to change one or more characteristics of a MEMS switch after production of the MEMS switch. In this way a MEMS switch can be trimmed, e.g. at an end user or just after production, to desired characteristics, to thereby attain a higher yield and/or a greater variety of MEMS switches from a single production. The characteristics can also be changed in an application, which, for example, needs one or more MEMS switches with different characteristics during different phases. In a first aspect of the invention this is attained by changing one or more parameters of the MEMS switch. In a second aspect of the invention this is attained by adding a switch beam position control loop.

The invention is not restricted to the above described embodiments, but may be varied within the scope of the following claims.

What is claimed is:

1. A micro electromechanical switching arrangement, comprising:

a switching element including a first support, an actuator control electrode, and a switching beam having a first end and a second end, the first end of the switching beam being supported by the first support;

a switching beam position measurement device for generating a beam position signal related to a position of the switching beam in relation to a position of the actuator control electrode; and an actuator control signal unit for generating an actuator control signal in dependence on the beam position signal and a desired switching beam position signal, the actuator control signal being coupled to the actuator control electrode.

2. The micro electromechanical switching arrangement according to claim 1, wherein the switching element further comprises a second support, the second end of the switching beam being supported by the second support.

3. The micro electromechanical switching arrangement according to claim 1, wherein the switching beam position measurement device is configured to use capacitive measurement methods for generating the beam position signal.

4. The micro electromechanical switching arrangement according to claim 1, wherein the switching beam position measurement device comprises a variable capacitance element and a Wheatstone bridge in which the variable capacitive device is one element.

* * * * *